US006220251B1

(12) United States Patent
Jeong et al.

(10) Patent No.: US 6,220,251 B1
(45) Date of Patent: Apr. 24, 2001

(54) COMBINATION VISION ENHANCEMENT KIT AND NAIL CLIPPER

(76) Inventors: Seong Won Jeong, 104 dong-103ho Jin Do Apt. 537-2 Duck So-Ri Wabu-Yup, Nam Yang Ju-shi, Kyunggi-Do; Sang Hoon Jung, 305-805 LG Apt. 530 Keumkok-Dong Kwonseon-Gu, Suwon Kyonggi-Do, both of (KR)

( * ) Notice: Subject to any disclaimer, the term of this patent is extended or adjusted under 35 U.S.C. 154(b) by 0 days.

(21) Appl. No.: 09/415,518

(22) Filed: Oct. 7, 1999

(51) Int. Cl.[7] ..... A45D 29/18
(52) U.S. Cl. ..... 132/73.5; 132/75.5; 30/28
(58) Field of Search ..... 132/73.5, 75.3, 132/75.4, 75.5; 30/28, 26, 27, 29; 359/802, 368, 379

(56) References Cited

U.S. PATENT DOCUMENTS

| | | | | |
|---|---|---|---|---|
| 2,999,505 | * | 9/1961 | Herstedt | 30/28 |
| 3,680,210 | * | 8/1972 | Steinman | 30/28 |
| 3,744,883 | * | 7/1973 | Williams | 350/244 |
| 3,955,884 | * | 5/1976 | Del Pesco | 350/248 |
| 4,398,800 | * | 8/1983 | Hayes | 350/251 |
| 4,640,011 | * | 2/1987 | Gamble | 30/28 |
| 4,788,768 | * | 12/1988 | Ohori | 30/28 |
| 4,809,431 | * | 3/1989 | Idema | 30/28 |
| 4,893,406 | * | 1/1990 | Larson | 30/28 |
| 4,930,871 | * | 6/1990 | Tannahill | 350/243 |
| 4,956,915 | * | 9/1990 | Anderson | 30/28 |
| 5,046,606 | * | 9/1991 | Morelli | 206/37 |
| 5,263,754 | * | 11/1993 | Coleman | 294/99.2 |
| 5,357,677 | * | 10/1994 | West | 30/28 |
| 5,358,297 | * | 10/1994 | Coleman | 294/99.2 |
| 5,370,648 | * | 12/1994 | Cracraft | 606/131 |
| 5,546,658 | * | 8/1996 | MacLeod et al. | 30/28 |
| 5,775,340 | * | 7/1998 | Rains | 132/73.5 |
| 5,931,167 | * | 8/1999 | Coleman | 132/73.5 |

* cited by examiner

*Primary Examiner*—John J. Wilson
*Assistant Examiner*—Robyn Kieu Doan
(74) *Attorney, Agent, or Firm*—Donn K. Harms

(57) ABSTRACT

A visual enhancement kit for use in combination with a nail clipper featuring a lens that may be dismounted and interchanged with any of a plurality of lenses of varying refractive qualities. The resulting field of view of the cutting edge of the clipper and the area adjacent thereto enhances the user's ability to see the work being done by the clipper. vice as claimed in claim 1 additionally comprising a means to vary the distance between said lens and cutting blades. The device may be attached to a conventional nail clipper already in use and features rotational positioning of the lens in relation to the user. The device may also be provided already attached to a nail clipper and optionally features the ability to vary the distance between the lens and the cutting edge of the clipper which is user adjustable. Using hinged connections the lens may be folded for storage in a storage compartment formed from components of the device. The device is further enhanced by an optional light source.

20 Claims, 2 Drawing Sheets

COMBINATION VISION ENHANCEMENT KIT AND NAIL CLIPPER

BACKGROUND OF INVENTION

1. Field of Invention

The present invention relates to an attachment to a cutting device for providing improved vision for the user of the material being cut. More particularly, it relates to a device configured for use in combination with a nail clipper that provides one or both of a lens to view the material being cut and a light source to illuminate the material being cut. The device may be provided in a mounted form specifically configured and mounted to a pair of nail clippers, or it can also be provided in an aftermarket configuration with a means of attachment to conventional nail clippers.

The device features one or a plurality of lenses for attachment to a conventional nail clipper to aid the user in viewing the nail or material being cut. The lens and attachment may be in kit form and feature a plurality of different lenses that could magnify the field of view or act as corrective lenses for the field of view for users with vision impairment. In this manner the lens could correct the vision of a far sighted user or a different lens might be used for a user who is near sighted. Optionally, an illumination means can also be provided to increase the vision enhancement of the user.

2. Prior Art

Personal hygiene generally requires that the nails of the hands and feet be groomed on a fairly regular basis for humans as well as in many animals such as dogs and cats. Human nails constantly grow and elongate and consequently are constantly in need of trimming for health as well as aesthetic reasons. Many domesticated animals also have nails that grow too long and are in need of trimming to prevent injury to the animal from catching a nail on something such as a rug or furniture.

It is thus desirable to have a tool or tools to easily and safely trim constantly elongating nails on humans and animals who require such trimming. The tool of choice in most cases is the conventional nail clipper which conventionally features two opposing blades biased away from each other and which communicate when the bias is overcome by activation of a lever attached thereto. The blade surfaces meet and cut the nail which is first inserted in between the two blades.

Currently, conventionally used nail clippers depend upon the natural vision of the user to see the nail which is intended for cutting, and place it properly in the very small area in between the two opposing cutting blades of the clipper. Placing the nail too far into the blades will cause too much to be removed. Conversely, placing too little of the nail to be cut into the clipper causes too little to be cut away requiring a second and more detailed cut since the amount to be removed has been lessened by the first incorrect cut.

As is obvious, it is imperative for the user to be able to see the nail and surrounding surface clearly, to determine the amount to be cut from the nail and to determine what areas not to cut which would cause injury. It is equally imperative for the clipper user to be able to clearly view the nail surface when inserted into the nail clipper to determine that the proper amount is placed into the jaws of the clipper. Currently, the user must depend on his good vision and ability to focus on the nail and work area of the clipper to reach the proper conclusion on cutting.

As is disclosed herein, the lens system for use in combination with a nail clipper provides the user with the capability to enhance the user's natural ability to see both the nail to be clipped, and, the working area of the clipper blades which are in the field of view of the user during use of the clipper. By enhancing the view of the work area of the clipper as well as the nail to be clipped and surrounding areas, the user is provided a major improvement in both safety and utility when using a nail clipper.

Using a magnifying lens in the viewer, the user can magnify the field of view seen through the lens to show more detail about the nail to be cut and the working area of the clipper jaws. Optionally, corrective lenses might also be mounted in the viewer to allow far sighted users the ability to groom their nails without the need for eyeglasses or other corrective lenses.

When manufactured as a unit, which would be the best current embodiment of the disclosed device, the viewer with lens can be attached to the clipper using attachment or rotational attachment means in the form of hinges and swivels to allow the lens to fold away against the clipper body during non use. The complete unit would also allow for a cover to protect the lens when folded away. The viewing lens might also be provided with an attachment means configured to attach or cooperatively engage with conventional nail clippers already in use thereby allowing current owners of nail clippers to enhance such devices by the attachment of the viewing lens to the clipper in a manner to place the lens in a position to provide a field of view which includes the nail and the cutting edges of the clipper. Of course either device could also optionally be provided with multiple lenses having different optical effects to provide more or less magnification or vision correction as the case may be.

In the embodiment which is manufactured with the viewing device attached, an optional light means with low current requirements such as a light emitting diode could also be included to further enhance the field of view. If this optional light means were provided, a white or yellow LED which activates with slight pressure on the cutting lever would thereby provide addition light to the field of view seen through the lens of the viewing device and thereby further enhance the user's view.

Current nail clipping devices however still only provide a cutting area activated by a lever and the user must attempt to see what is being cut unaided. As such, there exists a need for an easily and inexpensively manufactured viewing enhancement device that is attachable during manufacture of nail clippers, or with an attachment means allowing the viewing enhancement device to be attached to conventionally used and owned nail clippers.

Further utility would be allowed by the provision of a plurality of lenses of differing optical enhancement characteristics thus allowing the user to change lenses in the viewing enhancement device to meet the individual visual needs of the user. Even more utility would be provided by the optional addition of a light means mounted on the viewing enchantment device which would be situated to provide light to the field of view seen through the lens of the device.

SUMMARY OF THE INVENTION

Applicants' device is an easily manufactured and utilized apparatus, which provides enhanced user viewing of the nail or other area to be clipped by the cutting blades of the nail clipper. This visual enhancement is provided by a magnifying or other lens which is positionable to allow the user a field of view through the lens, of the nail to be clipped as well as the blades which perform the task.

The device features a lens having an attachment means whereby it can be attached to a conventional nail clipper in a position to view the clipper blades and nail through the lens. In its simplest embodiment it would feature the lens and an attachment means to allow attachment of the lens to a conventional nail clipper in the proper position to provide the user the viewing aid of the blade and nail being clipped. Consequently, it would be immediately available to millions of users worldwide who already have nail clippers.

In the best embodiment of the device, it would be manufactured and provided in combination with a nail clipper and would feature the ability to fold away into a properly configured storage compartment formed into the nail clipper. An optional light means could also be attached to illuminate the work area of the nail clipper to further enhance the view and utility of the device.

An object of this invention is to provide visual enhancement of the user's view of nails being clipped by a nail clipper.

Another object of this invention is to provide additional safety to the user of a nail clipper which better vision inherently provides.

A further object of this invention is the provision of a magnified view of the cutting end of a nail clipper and the nail to be clipped therein.

A still further object of this invention is to provide an infinite number of positions of the lens to the user such that the user can always move the lens to a position and angle suitable for the task at hand.

An additional object of the invention is to provide a plurality of lenses that are interchangeable with a mount therefor and thereby provide varying degrees of vision correction and/or enhancement to the user by changing the lenses to meet the user's need.

Further objects of the invention will be brought out in the following part of the specification, wherein the detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figures 1, 2, 3:
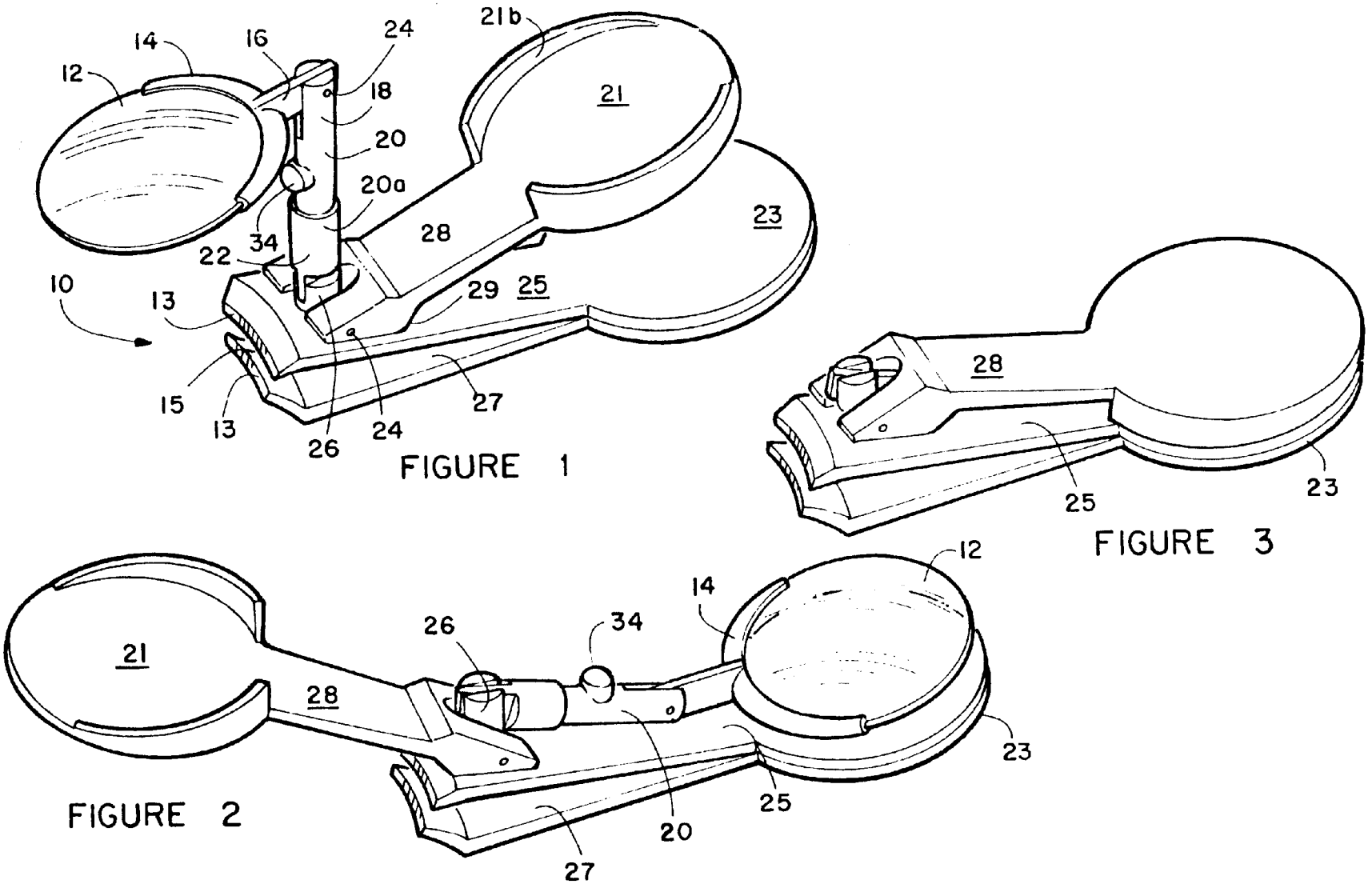
FIG. 1 is a perspective view of an embodiment of the device showing the vision enhancing lens in operational position.
FIG. 2 is a perspective view of the disclosed device showing the vision enhancing lens folded to a stored position away from the cutting area.
FIG. 3 is a perspective view of the disclosed device showing the protective cover in place over the vision enhancing lens.
Figure 6:
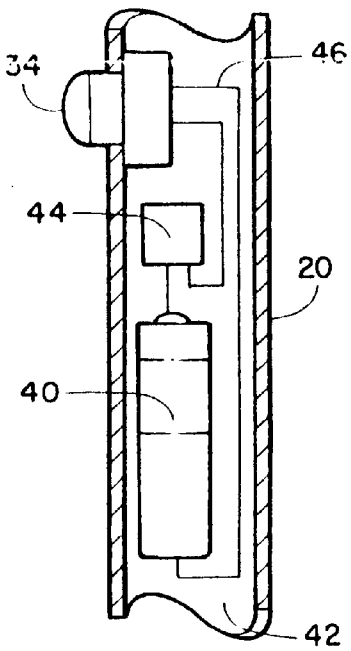
FIG. 6 depicts a conventional arrangement of a battery stored inside of a chamber with an activation switch to energize a light means for use.

Referring now to the drawing FIGS. 1–5, specifically FIG. 1 depicts a perspective view of a first embodiment of the disclosed device 10 showing the vision enhancing lens 12 in operational position wherein the user has a clear field of view from the top side 14 of the lens 12 through the lens 12 providing a view adjacent to the cutting blades 13 located at one end of both the upper blade member 25 and the lower blade member 27. The lens 12 can be made from glass, or plastic however plastic would be the current best mode due to the better refractive qualities available in plastics such as those used in contact lenses and other synthetic material lenses. In the field of view through the lens 12 the user can also easily see the area directly in front of the cutting blades 13 where the nail and finger would be located during use, as well as the gap 15 between the cutting blades 13 in which a nail would be placed for cutting by the cutting blades 13 in the conventional fashion of a nail clipper.

If the lens 12 has magnification optical qualitites, everything in the field of view of the user is magnified by the power of magnification of the lens 12. The user thus has a better view of the finger, the fingernail, and the target gap 15 into which the finger nail must be inserted. Of course the lens 12 might also be optically configured to provide vision correction to users who desire the use the nail clipper device 10 who might be visually impaired or just want to take off their glasses during use of the device 10. By providing a plurality of lenses 12, of differing vision correction or magnification strength, in a kit, which are mountable to lens mount 16, the device would provide additional utility to users in that they would have the option to substitute one of the plurality of lenses 12 to meet their current vision needs, or desire for magnification, for using the device. Further utility is provided by the provision of a means to rotate the lens 12 as depicted in the current best mode by the optional swivel mount 17 which allows the lens 12 to rotate toward or away from the user's view when using the device, thus allowing for infinite adjustment of the viewing angle which the user may choose to look through the lens 12 to the field of view below. The swivel mount 17 as depicted would allow for the lens 12 and one side of the lens mount 16 to rotate and would frictionally engage when force was not being applied to rotate it. Of course other swivel style mounts could be used to achieve rotation of the lens 12 and such are anticipated.

In an economy model it would be possible to simply make the lens 12 and the mount 16 as one unit and even make the lens 12 the mount itself. However the current best mode with the most utility provides the lens 12 attachable to the mount 16 to allow for swiveling and rotating the lens as well as interchangeable lenses in the mount 16.

Further utility is provided by the device 10 through the provision of a means to vary the position of the lens 12 in relation to the cutting blades 13. In the disclosed device 10 this means to vary the position of the lens 12 is provided by an elongated rod 20 configured at a first rod end 22 for hinged mounting with pivot pin 26, and at the second end 32 for hinged mounting with the lens mount 16. By rotating both the first rod end 22 and the second rod end 32 on hinge pins 24 the lens 12 may be positioned to align the field of view therethrough with the eye of the user during use. This hinged mounting at both ends of the elongated rod 20 also allows the lens 12 and attached lens mount 16 to be rotated on the pivot pin 26 such that the lens 12 and communicating lens mount 16 may be positioned in a storage position at the distal end of the upper and lower blade members 25 and 27 which is the ends opposite to the cutting blades 13. By using a hinge pin 24 slightly flexible in nature, when the rod 20 is rotated to an upright position, the hinge pin 24 will flex to allow the shoulder at the first rod end 22 to move over the upper edge 31 of the hinge pin 26 and thereafter be held in operating position by the bias or flex of the hinge pin 24. Of course other biasing means could be used to bias the first rod end 22 toward the upper edge 31 and hold the rod 20 upright such as springs, but the current best mode features the resilient or flexible hinge pin 24.

To rotate the lens 12 and lens mount 16 to the storage position, the user can rotate the elongated rod 20 toward the distal ends of the upper and lower blade members 25 and 27 until the elongated rod 20 contacts the inner surface 21 of biasing lever 28. The lens 12 and lens mount 16 at the communication point of the lens mount 16 and elongated rod 20 is also rotated on pin 24 such that one side of the lens 12 contacts the inner surface 21 of biasing lever 28. Thereafter both the biasing lever 28 and elongated rod 20 are rotated 180 degrees from the pictured position in FIG. 1 by twisting pivot pin 26 inside of its mount through lower blade member 27. Once positioned opposite the distal end 23 of upper blade member 25, the biasing lever 28 is rotated on pin 24 at the cooperative engagement of the first rod end 22 with pivot pin 26. This rotation allows the inner surface 21 of biasing lever 28 to move toward the distal end 23 of upper blade member 25 and make contact therewith at a shoulder portion 21*b* of biasing lever 28 thereby forming a storage compartment for the lens 12 and lens mount 16 defined by the area between the shoulder portion 21*b,* the inner surface 21 and the surface of distal end 23 of upper blade member 25. The device with lens 12 so stored in the formed storage compartment is depicted in FIG. 3.

The nail clipper portion of the device 10 functions in the same fashion as conventional nail clipper in a well known fashion with the cutting blade 13 formed on both the upper blade member 25 and lower blade member 27 having a gap 15 there between when in a biased static position. The nail to be cut is inserted into the gap 15 a desired distance and the upper blade member 25 is forced toward the lower blade member 27 by downward pressure of the user on the inner surface area 21 of biasing lever 28. This downward pressure rotates the end the inner surface area 21 on hinge pin 24 thereby forcing biasing shoulder 29 of the biasing lever 28 into the upper blade member 25. The upper blade member 25 therein is forced toward the lower blade member 27 until the gap 15 disappears when the two blades 13 contact each other thereby cutting the nail inserted into the gap 15. Variations on this well known operation exist and are as such anticipated.

The provision of the elongated rod 20 and cooperatively engaging pivot pin 26 provides a means for attachment of the lens mount 16 and communicating lens 12 to the disclosed device 10 or similar conventional style nail clipper.

Figure 4:
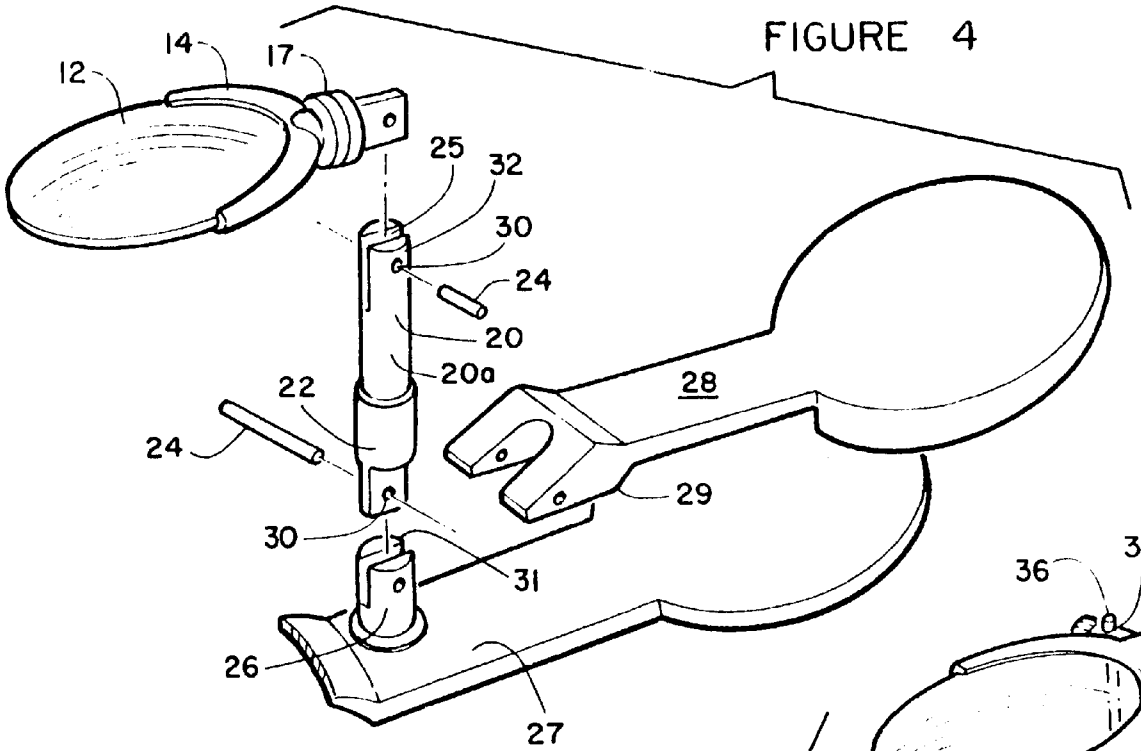
FIG. 4 is an explode view of a typical hinge and pin attachment of the lens to the cutting end of a nail clipper.

As noted earlier, for the millions of nail clippers already in use and lacking the variable positionable lens 12 and vision enhancing characteristics of the disclosed device 10. For the installed or in use base of nail clippers, an embodiment of the device could also be provided as an add on to existing clippers. In such an embodiment, as depicted in FIG. 4, a pivot pin 26 configured to mount in the standard aperture of the lower blade member 27 of a conventional nail clipper would be provided. The pivot pin 26 would therein be substituted for the pin that originally came with the nail clipper being modified and thereafter the cooperatively engageable elongated rod 20 would be mounted to the pivot pin 26 and the lens 12 would be mounted to the opposite end of the elongated rod 20 from the pivot pin 26 using the cooperatively engageable lens mount 16. The depicted hinge pins 24 mounted through apertures 30 is the most common method for cooperatively engageable rotatable mounts but other mounts could be used and are anticipated.

Figure 5:
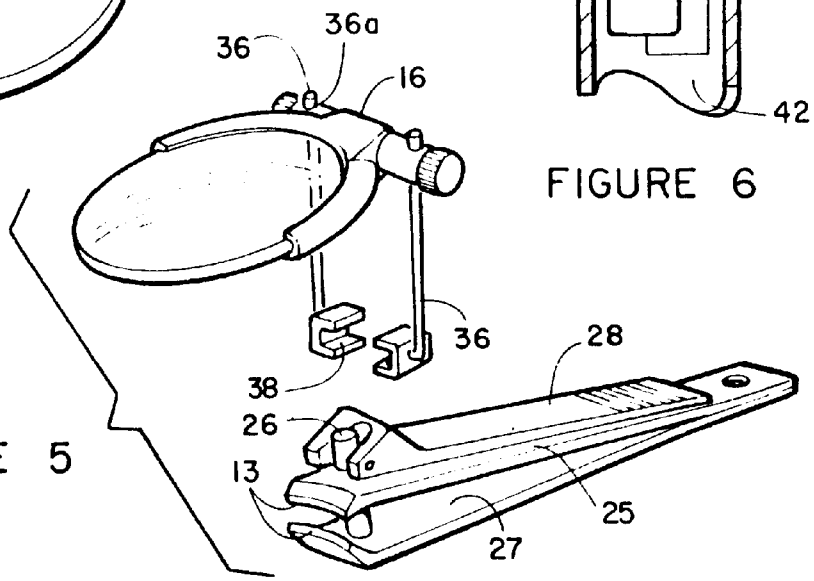
FIG. 5 depicts a perspective view of an embodiment of the vision enhancing lens configured to attach to a conventional nail clipper.

Another add on embodiment for cooperative engagement of the vision enhancing lens 12 with existing clippers is depicted in FIG. 5. In this embodiment the lens 12 is removably mounted in lens mount 16 if multiple lenses are provided in a kit, or permanently mounted if only one lens is used. The mount 16 which is rotationally attached in the aforementioned manner using the optional swivel 17 and/or a rotational engagement at pin 24 adjacent to elongated member 36 which would allow the mount to swivel or rotate. The blade mounting means is depicted in this embodiment as a plurality of elongated members 36 attached at one end to the lens mount 16 and having fasteners 38 attached at the second end designed for cooperative engagement with one of the upper blade member 25 or lower blade member 27. This allows the lens to be attached to a conventional clipper for retrofit and while the current best mode depicts U shaped fasteners 38 configured and constructed to biasly engage and attach to the outer edges of the lower blade member 27. Other means of attachment could be used to hold the members 36 to the lower blade member 27 or if desired the upper member, other than the depicted current best mode and such are anticipated. Attachment of the U shaped fasteners 38 and communicating members 36 to the lower blade member 27 is desirable in retrofit instances of existing nail clippers, since in most conventional nail clippers, the lower blade member 27 moves little if at all during operation. Thus the best cooperative engagement of the elongated members 36 to hold the attached lens mount 16 and lens 12 would be found with the lower blade member 27 thus providing a stable mount for the lens 12 during use of the clipper and providing the user the benefits of enhanced or corrected vision from the lens 12 used.

For additional utility if desired, an optional light means can be provided using a light emitting diode (LED)34 or small light bulb as the light means. Electric power could be provided in a number of conventional fashions such as a conventional battery 40 located inside a hollow portion 42 of elongated rod 20 with electrical switching means such as the depicted mercury switch 44 communicating power through wires 46 to the LED 34 or light bulb when the central axis of the elongated rod is substantially in line with a central axis of pivot pin 26. Access to the chamber 42 would be provided in the conventional fashion by a removable plate in rod 20 or similar chamber access means. Provision of electric battery power and switching thereof is conventionally achieved in a variety of well know fashions and such are therefor anticipated.

Another optional component to provide even further utility to users desiring enhanced adjustability of the position of the lens 12 during use, can be provided by a means for varying the distance between the lens 12 and the cutting blades 13 at one end of the elongated members 36 as depicted in FIG. 5. In this embodiment, member apertures 36*a* placed in the lens mount 16 would frictionally engage the exterior surface of the elongated members 36 and allow them to slide higher or lower on the elongated members 36. The user would then have the ability to raise or lower the position of the lens 12 in relation to its position above the clipper during use, as well as rotate the lens at the axil or the swivel 17 if included. Alternatively, the means for varying distance between the lens 12 with the cutting blades 13 of the blade members could be provided with the rod 20 constructed in a manner to allow it to telescope to longer or shorter positions by the provision of one or a plurality of communicating sections which slide into each other at communication points 20*a*. The result being a lense positionable to an infinite number of lens positions and angles for the user, during operation of the device. This angle adjustment ability, along with the ability to change the distance of the lens from the cutting edges, along with the ability to change lenses and refractive characteristics provided by the device, combine to yield a powerful improvement to current nail clipping devices.

While all of the fundamental characteristics and features and various embodiments of the Combination vision enhancement kit and nail clipper have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A visual enhancement kit for use in combination with a nail clipper having an upper blade member and lower blade member operationally connected by a pivot pin adjacent to their respective cutting edges comprising:

a lens, said lens having the desired refractive qualities to yield a view therethrough desired by a user; and means for attaching said lens to said pivot pin of said nail clipper and for maintaining said lens substantially stationary during use of said nail clipper.

2. The device as claimed in claim 1 wherein said means for attaching said lens to said nail clipper comprises:

a lens mounting bracket attachable to said lens;

an elongated member, said elongated member attached at a first end to an attachment point of said lens mounting bracket, said elongated member at a second end terminating at a member fastener;

said member fastener configured to cooperatively engage said pivot pin of said nail clipper.

3. The device as claimed in claim 1 additionally comprising a means to vary the distance between said lens and said respective cutting edges of said upper blade member and said lower blade member.

4. The device as claimed in claim 2 additionally comprising a means to vary the distance between said lens and said cutting blades of said upper blade member and said lower blade member.

5. The device as claimed in claim 2 further comprising hinged engagement of said member fastener to said pivot pin and hinged engagement of said elongated members to said mounting bracket.

6. The device as claimed in claim 2 additionally comprising:

said lens being removably attachable to said mounting bracket;

said lens being replaceable in said mounting bracket with any one of a plurality of additional lenses configured to be removably attachable to said mounting bracket, whereby lenses with different refractive qualities may be attached to said mounting bracket depending on user preference.

7. A combination nail clipper and visual enhancement kit attachable thereto comprising:

a nail clipper;

said nail clipper having an upper blade member having a cutting end and a distal end;

said nail clipper having a lower blade member having a cutting end and a distal end;

a pivot pin cooperatively engaging said upper blade member and said lower blade member adjacent to said cutting end;

a biasing lever, said biasing lever attached to said pivot pin, said biasing lever when depressed causing said cutting end of said upper blade member to contact said cutting end of said lower blade member at a contact point;

a lens; and means of attachment of said lens to said pivot pin of nail clipper means for attaching said lens to said pivot pin of said nail clipper and for maintaining said lens substantially stationary during use of said nail clipper.

8. The device as claimed in claim 7 wherein said field of view through said lens comprises said contact point and an area immediately adjacent thereto.

9. The device as claimed in claim 11 wherein said means of attachment of said lens to said nail clipper comprises:

a lens mount attached to said lens; and means of attachment of said lens mount to said pivot pin of said nail clipper.

10. The device as claimed in claim 9 wherein said lens configured for removable attachment to said lens mount.

11. The device as claimed in claim 10 further comprising:

a plurality of lenses, each similarly configured for removable attachment to said lens mount.

12. The device as claimed in claim 11 wherein said plurality of lenses have different refractive characteristics thereby yielding different views therethrough which can be changed at the option of the user by removing a lens and attaching one of said plurality of lenses.

13. The device as claimed in claim 9 additionally comprising:

a swivel attached to said lens mount whereby said lens mount and said attached lens may be rotated.

14. The device as claimed in claim 9 wherein said means of attachment of said lens mount to said nail clipper comprises an elongated rod configured at a first end for cooperative engagement with said lens mount and configured at a second end for cooperative engagement with said pivot pin.

15. The device in claim 14 additionally comprising a means to vary the distance of said lens from said contact point.

16. The device as claimed in claim 15 wherein said means to vary the distance of said lens from said contact point comprises said elongated rod being constructed of a plurality of pieces which telescope to a longer or shorter length.

17. The device as claimed in claim 14 additionally comprising:

said cooperatively engagement of said first end of said elongated rod with said lens mount being hinged thereby allowing said lens mount to rotate at said cooperative engagement of said first end with said lens mount.

18. The device in claim 14 additionally comprising:

said cooperative engagement of said second end of said elongated rod with said pivot pin being hinged and thereby allowing said elongated rod to rotate at said cooperative engagement with said pivot pin.

19. The device in claim 14 further comprising:

both of said first end and said second end of said elongate rod are hinged at their respective cooperative engagements;

said elongated rod is rotatable to a position in contact with a top surface of said upper blade member;

said biasing lever has a shoulder portion at the end distal to said pivot pin;

said biasing lever is rotatable on said pivot pin, to an inverted position, whereby said biasing lever covers said elongated rod and attache lens, when said elongated rod is in said position in contact with said top surface of said upper blade member; whereby a storage compartment for said lens is formed by the surface of the biasing lever inside the shoulder portion and the shoulder portion, and the top surface of said upper blade member inside the area of said shoulder portion.

20. The device as claimed in claim 14 comprising:

an electric light source mounted upon said elongated rod in a position to illuminate said field of view;

a battery for communicating power to said electric light course; and an electrical switch means providing communication of power from said battery to said light electric light source when activated.

* * * * *